United States Patent [19]

Tronc

[11] Patent Number: 4,639,641

[45] Date of Patent: Jan. 27, 1987

[54] SELF-FOCUSING LINEAR CHARGED PARTICLE ACCELERATOR STRUCTURE

[75] Inventor: Dominique Tronc, Chatou, France

[73] Assignee: C. G. R. MeV, Buc, France

[21] Appl. No.: 644,540

[22] Filed: Aug. 27, 1984

[30] Foreign Application Priority Data

Sep. 2, 1983 [FR] France ..... 83 14090

[51] Int. Cl.[4] ..... H01J 25/10

[52] U.S. Cl. ..... 315/5.41; 315/5.42

[58] Field of Search ..... 315/5.41, 5.42

[56] References Cited

U.S. PATENT DOCUMENTS

| | | | |
|---|---|---|---|
| 2,770,755 | 11/1956 | Good | 315/5.42 |
| 2,925,522 | 2/1960 | Kelliher | 315/5.41 |
| 3,784,873 | 1/1974 | Tronc et al. | 315/5.42 |
| 4,150,322 | 4/1979 | Tran et al. | 315/5.42 |
| 4,160,189 | 7/1979 | Tran et al. | 315/5.42 |
| 4,162,423 | 7/1979 | Tran | 315/5.41 |
| 4,211,954 | 7/1980 | Swenson | 315/5.41 |

*Primary Examiner*—Saxfield Chatmon
*Attorney, Agent, or Firm*—Roland Plottel

[57] ABSTRACT

A self focusing linear charged particle accelerating structure is provided which avoids the radial defocusing effect of the particle beam, more particularly at the outlet of a first accelerating cavity which this structure comprises. Said first accelerating cavity comprises an inlet face and an outlet face which are spaced apart by a distance formed by an accelerating length plus an additional length intended to delay the arrival of the particles at said outlet face.

4 Claims, 3 Drawing Figures

SELF-FOCUSING LINEAR CHARGED PARTICLE ACCELERATOR STRUCTURE

BACKGROUND OF THE INVENTION

The invention relates to a self-focusing linear charged particle accelerator structure intended to equip a linear electron accelerator.

Linear charged particle accelerators are used in numerous fields such as scientific, medical and even industrial depending on their application, these accelerators produce beams or particles, electrons for example, having energies often ranging from one to several tens of MeV.

The electric power consumed by these accelerators is considerable, it may for example reach 130 Kw only 20 Kw of which are to be found in the accelerated beam; thus the overall efficiency of such an accelerator has a direct and considerable bearing on the cost of using this accelerator, and an improvement of its efficiency by optimizing the elements which form it is a constant preoccupation of specialists, the improvement of the efficiency being also often related to the improvement of the qualities of the beam obtained.

Linear electron accelerator structures are generally formed by a succession of resonant cavities whose dimensions are related to the frequency of an electromagnetic wave injected into the structure for accelerating the electrons, and to the speed of the electrons.

Traditionally, accelerating structures are optimized in so far as the longitudinal dynamics are concerned; the lengths of the resonant cavities which form accelerator cavities are chosen so as to accelerate the electrons continually in each of them.

The accelerating part of the electromagnetic wave is at most equal to its half period and so as to benefit from a maximum of energy yielded by this wave to the electrons, that is to say a high value of the so called "transit angle" coefficient, these cavities generally have a length l substantially equal to the product of a quarter to a third of the length λo of the electromagnetic wave multiplied by the relative speed $\beta$ of the electrons, in accordance with the following relationship:

$$l \approx \beta(\lambda o/n);$$

where $\beta$ is the quotient of the average speed V of the electrons divided by the speed C of light ($\beta = V/C$), and n is between 3 and 4. This length, defined within the scope of calculation of a conventional cavity, is called accelerating length.

Thus for example, in the case of an accelerator structure operating at 3000 MHz, i.e. a wave length λo equal to 100 mm and for $\beta = 0.5$, the accelerator cavities have a length of the order of about 12 to 16 mm, gradually increasing to reach 25 to 33 mm when $\beta = 1$.

This traditional approach in which optimization is limited to the longitudinal dynamics, is imperfect especially in that it does not take into account a radial defocusing effect of the beam along the accelerator structure, this effect asserting itself particularly in the first part of the structure where the energy of the electrons is still low.

This defocusing of the beam is generally compensated for by adding solenoids disposed concentrically about the accelerator structure so as to create a corrective magnetic field which increases the cost and the complexity.

SUMMARY OF THE INVENTION

The present invention provides a self focusing charged particle accelerator structure in which the defocusing effect of the beam is avoided by removing one of its causes, contrary to the structures of the prior art where this effect is only compensated for.

In the accelerator structure of the invention, this is obtained by a simple and inexpensive arrangement of the sole or of the first accelerator cavity of this structure and is particularly applicable in the case where, in this cavity, the exit hole of the beam has a diameter less than the previously mentioned accelerating length; this arrangement is remarkable in that, in this latter case, account may be taken of the fact that the radial component of the electric field in the accelerating cavity forms one of the principle causes of the divergence of peripheral charged particles of the beam, and that this radial component is located in the vicinity of the inlet and outlet faces of the cavity and has contrary effects at the inlet and at the outlet of this cavity.

According to the invention, in a self-focusing linear charged particle accelerator structure, comprising a first accelerating cavity of a succession of accelerating cavities, for acclerating a charged particle beam under the effect of an electromagnetic wave of a given frequency F injected into said structure, said first cavity having an axis merging with a longitudinal axis of said structure and the axis of said beam and comprising an inlet face and an outlet face having respectively an inlet hole and an outlet hole for said beam, the distance between the inlet and outlet faces of said first cavity is formed by an accelerating length, plus an additional length for delaying the arrival time of the particles at the outlet face.

By accelerating length is meant a length over which the electrons are accelerated, as was explained above, this accelerating length being defined by the following relationship:

$$\text{accelerating length} = \beta(\lambda o/n),$$

where:

$\beta = V/C$;

n=3 to 4.

Because of the additional length between the inlet face and the outlet face of this first cavity of the accelerator structure of the invention, the particles are not subjected to the defocusing action of the radial component located near the outlet face, this radial component either disappearing or even becoming focusing; the only minor disadvantage consists in a slight deceleration of these particles before they have passed the outlet hole.

BRIEF DESCRIPTION OF THE DRAWINGS

The invention will be better understood from the following description of one embodiment of an accelerator structure in its broad lines, made with reference to the accompanying drawings in which.

DETAILED DESCRIPTION OF THE INVENTION

Figure 1:
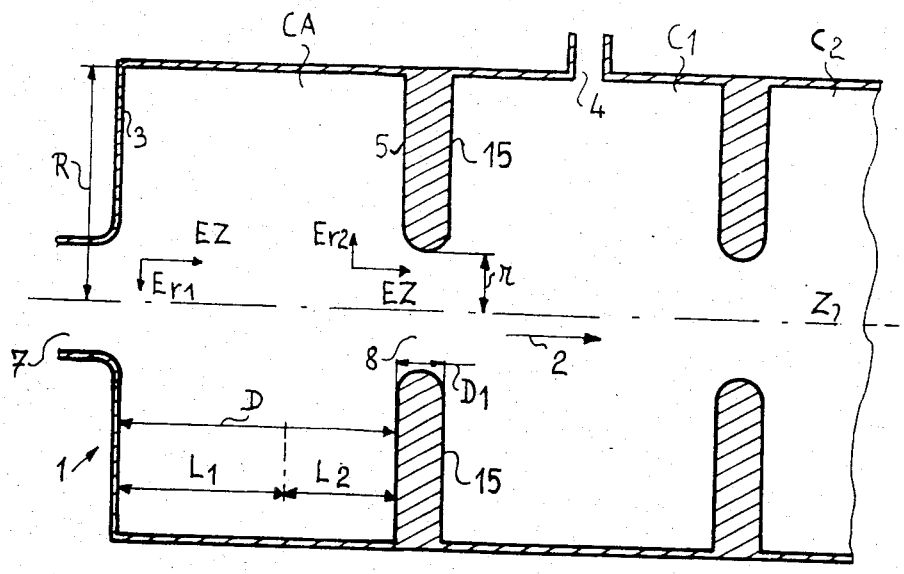
FIG. 1 is a partial schematical sectional view of the accelerator structure of the invention.

FIG. 1 shows partially a linear accelerator structure 1 in accordance with the invention, comprising a first accelerating cavity CA followed by n accelerating cavities $C_1, \ldots, C_n$, n being in the example described equal to 2. So called coupling cells which may be provided have not been shown since they are conventional elements disposed between the cavities $C_1, \ldots C_n$ in a way known per se.

Structure 1 comprises a longitudinal axis Z merging with the axis of the first cavity CA and which also forms the axis of particle beam (not shown) propagating in the direction of the arrow 2; this particle beam is accelerated through the energy of an electromagnetic wave (not shown in FIG. 1) injected in a conventional way into structure 1 through a coupling hole 4.

The first cavity CA, cylindrical in shape, comprises an inlet face 3 and an outlet face 5 normal to the axis of beam Z and spaced apart from each other by a distance D; the inlet face 3 is provided with an inlet hole 7, the outlet face 5 is provided with an outlet hole 8, these two holes being centered on the axis Z of the beam. The particle beam coming for example, in a way known per se, from an electron gun followed by a sliding element (not shown), penetrates into the first accelerating cavity CA through the inlet hole 7 and leaves this cavity CA through the outlet hole 8, and is propagated in structure 1 in the direction shown by arrow 2.

Considering the speed of the particles, they are accelerated over a path such for example as the accelerating length $L_1$ which, in the invention, corresponds to a fraction of the distance D between the inlet face 3 and the outlet face 5 of the first cavity CA; in the non limiting example described, the accelerating length $L_1$ corresponds to a length substantially equal to the relationship $\beta(\lambda o/n)$ where: $n=3$ to 4, $\lambda o$ is the wave length of the electromagnetic wave and $\beta$ corresponds to the relative speed of the electrons. This relative speed of the electrons is calculated by taking the average between the entry speed into the first cavity CA and the maximum speed reached in this cavity at the outlet of the accelerating length $L_1$. It should be noted that some electrons are decelerated right at the beginning of their trajectory, which is not taken into account in the approximation of the accelerating length $L_1$.

The electromagnetic wave injected into structure 1 defines an electric field having a longitudinal component $E_z$ and radial components $Er_1$, $Er_2$, and the distribution and intensity of these radial components is influenced by the dimension of the inlet and outlet holes 7,8. Thus, in the non limitative example of the description where the radii r of these holes are equal, localization of the radial components $Er_1$, $Er_2$, is obtained, the radius r of the holes 7, 8 being sufficiently small with respect to the accelerating length $L_1$ for the ratio $2r/L_1$ to be less than 1. Thus:

a first radial component $Er_1$ is located proximate the inlet face 3 and has a substantially converging action. For some electrons, it may be broken down into a divergent action followed by a convergent action;

a second radial component $Er_2$ is located proximate the outlet face 5 and has a divergent action on the electrons.

Thus, assuming that the distance D between the inlet face 3 and the outlet face 5 is formed solely by the accelerating length $L_1$, peripheral particles (not shown) having crossed this distance D and arriving in the vicinity of the outlet hole 8 and the outlet face 5 would undergo the defocusing influence of the radial component $Er_2$ of the field.

On the contrary, in the structure 1 of the invention, since the same charged particles have passed over the first accelerating length $L_1$, they are not subjected to the influence of this divergent radial component $Er_2$, from which they are still separated by an additional length $L_2$; since the distance D between the inlet and outlet faces are formed by the addition of these two lengths $L_1+L_2$, and since the additional length $L_2$ is equal to or greater than twice the radius r of the outlet hole 8 ($L_2 \geqq 2r$). It should be noted that the inlet and outlet holes 7,8 in general comprise horns, not shown in FIG. 1, which is schematical, and radius r represents a mean approximative radius of the outlet hole 8.

The additional length $L_2$ is such that the electromagnetic wave is cancelled out, even reversed when these particles have passed over the distance D, they leave the first cavity CA through the outlet hole 8 without diverging; they may even, if the phase of the electromagnetic wave is reversed, undergo a convergent action and slight deceleration, the radial component being then also reversed. It will be noted that this additional length $L_2$ of the first cavity CA also promotes the convergent action at the inlet of the next accelerating cavity $C_1$ which forms the second cavity. In the non limitative example described, the distance $D_1$ between the outlet face 5 of the first cavity CA and the inlet plane 15 of the second cavity $C_1$ is less than the accelerating length $L_1$, and thus provides substantial convergence at the inlet of the second cavity $C_1$, considering the phase shift of the electromagnetic wave between cavities CA, $C_1$, $C_2$. Thus the combined effect of the inlet of the first cavity CA, of the outlet of this first cavity and of the inlet of the second cavity $C_1$ is optimized; then the energy gain is such that the effect of the outlet of the second cavity $C_1$ is (almost) negligible. For the sake of simplicity this convergence effect at the inlet of the second cavity $C_1$ is not mentioned in what follows.

The additional length $L_2$ is defined by the following relationship: $L_2=L_1.K$, where K is a coefficient between 0.5 and 1.

In one embodiment of the accelerator structure 1 in accordance with the invention, given by way of non limitative example, the first accelerating cavity CA has the following dimensions:

a radius R of the cavity CA is 40 mm;

the distance D between the inlet face 3 and the outlet face 5 is 25 mm; this distance D being formed by an accelerating length $L_1$ of 15 mm, to which is added the additional length $L_2$ of 10 mm;

the radius r of the outlet hole 8 is 3 mm;

the potential difference between the inlet face 3 and the outlet face 5 is of the order of 500 KV, and the frequency of the electromagnetic wave is 3000 MHz.

Since the distribution of the electric field is symmetrical with respect to the axis Z of the beam, it is not shown in the lower part of the first cavity CA.

This distribution of the electric field in the first accelerating cavity CA corresponds to the existence in this latter of an accelerator field.

Figure 2:
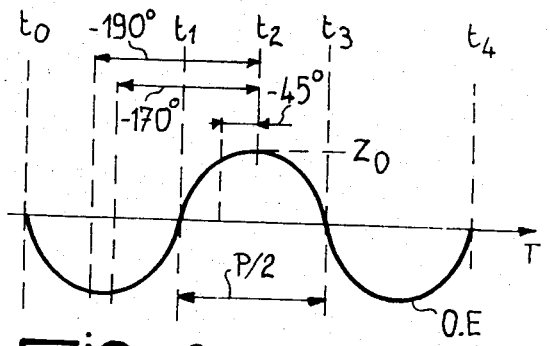
FIG. 2 illustrates the electromagnetic wave injected into this structure.

FIG. 2 shows the electromagnetic wave OE of which a half period P/2 determines this accelerator field and the part of which between time to and time t1 and between time t3 and time t4 determine a decelerator field;

time t2 corresponding to the peak value of the half period P/2 where the accelerator field Zo is maximum.

By taking as reference time t2 when the accelerator field is maximum (Zo), electrons may arrive in the first accelerating cavity CA with arrival phases $\phi o$ of any value whatsoever. But so as to avoid the defocusing effect due to the radial component $Er_2$ located close to the outlet face 5, these electrons will have to cross the distance D and reach the vicinity of this outlet face substantially at time t3 when the accelerator field is cancelled out, because of the additional length $L_2$.

Taking for example an electron (not shown) whose arrival phase $\phi o$ in the first cavity CA is 170° in advance with respect to Zo or time t2, this electron is subjected to a decelerating field in the vicinity of the inlet face 3 until time t1 when the wave OE is reversed and the field becomes accelerating; the action of the radial component $Er_1$, located near the inlet face 3, is thus first of all divergent then convergent when the field becomes accelerating and its action is substantially convergent. This slowed down electron is joined by electrons arriving in cavity CA after it. Thus the arrangement of the first cavity CA of structure 1 in accordance with the invention avoids the outlet defocusing effect for a large range of arrival phase values $\phi o$, for example between −45° and −190° with respect to Zo or time t1.

Figure 3:
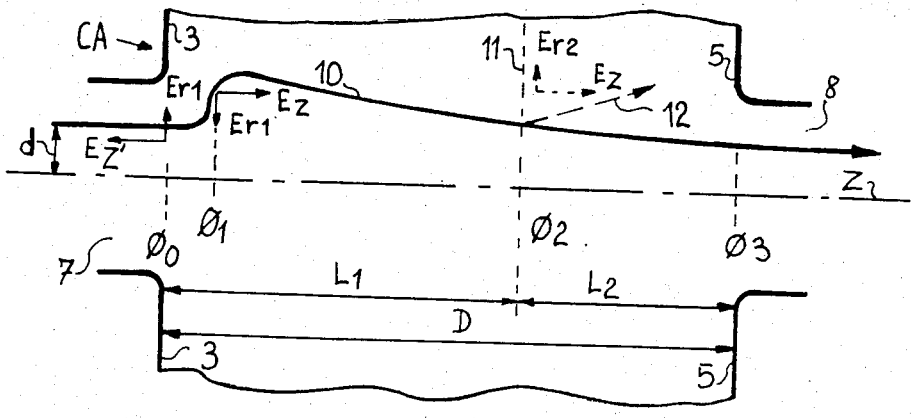
FIG. 3 illustrates the path of an accelerated electron.

FIG. 3 illustrates the path of a peripheral electron of the beam and shows the field components Er, Ez seen at different times, taking into account the finite speed of the electron.

The accelerating cavity is symbolized by its inlet and outlet walls 3, 5. Curve 10 shows the path of an electron penetrating into the first cavity CA with an arrival phase $\phi o$ equal to −170°, and at a distance d from the axis Z of the beam:

at time $\phi o$ the field is decelerating as shown by the longitudinal component $E_z'$, and the radial component $Er_1$ is defocusing;

at time $\phi 1$ the field is accelerating (longitudinal component Ez) and the radial component $Er_1$ is focusing; it should be noted that at this time the path 10 is very close to the inlet face 3, the electron having previously undergone deceleration and has moved further away from the axis Z of the beam;

at time $\phi 3$ the field is zero, the electron leaves the first cavity CA and tends to converge towards the axis Z of the beam.

Assuming that the distance D between the inlet face 3 and the outlet face 5 has been formed solely by the accelerating length $L_1$, the outlet face 5 would have occupied the position of line 11 shown with a broken line and the field to which the electron would then have been subjected on leaving the first cavity CA is represented in a broken line by components $Er_2$ and Ez; the path of the electron would have been modified as shown by arrow 12 in a broken line, which tends to diverge from the axis Z of the beam.

This description shows that the accelerator structure 1 of the invention eliminates the defocusing effect of the peripheral charged particles of the beam, at the outlet of an accelerating cavity. Such elimination of the divergence effect is obtained by a simple and economic arrangement which increases the efficiency of a linear charged particle accelerator.

What is claimed is:

1. In a self focusing linear charged particle accelerator structure, comprising a first accelerating cavity of a succession of accelerating cavities for accelerating a beam of charged particles under the effect of an electromagnetic wave of a given frequency F injected into said structure, said first cavity having an axis merging with a longitudinal axis of said structure and the axis of said beam and comprising an inlet face and an outlet face provided respectively for the passage of said beam with an inlet hole and an outlet hole of a given radius, the distance between said inlet and outlet faces of said first cavity comprising a conventional accelerating length L1, the radius r of the outlet hole being sufficiently small with respect to said accelerating length for the radio 2r/L1 to be less than 1, wherein said distance betewen said inlet and outlet faces is formed by said accelerating length plus an additional length to delay the time of arrival of the particles at said outlet face, and in which said additional length is chosen so that the outlet face corresponds to a region where the particles in the beam which have been bunched in transit through the first cavity no longer experience a radial divergent electric field component of the electromagnetic field at said outlet hole.

2. The accelerator structure as claimed in claim 1, wherein said additional length is equal to or greater than two radii of the outlet hole: $L_2 \geqq 2r$.

3. The accelerator structure as claimed in claim 1, wherein the first accelerating cavity is followed by a second accelerating cavity comprising an inlet plane, the distance of which to the outlet face of said first cavity is less than said accelerating length.

4. A linear changed particle accelerator according to claim 3 in which the surface of the second cavity includes an coupling hole which is adaptive to be connected to a source of high frequency energy and the first cavity is supplied by high frequency energy from said source only by way of the outlet hole between the first and second cavities.

* * * * *